US007671003B2

(12) United States Patent
Barry et al.

(10) Patent No.: US 7,671,003 B2
(45) **Date of Patent: *Mar. 2, 2010**

(54) UNIT DOSE DETERGENT PRODUCT COMPRISING SILICONE OIL

(75) Inventors: Susan Mary Barry, Ixelles (BE); Frantz Beznik, Cincinnati, OH (US); Francesco De Buzzaccarini, Breendonk (BE); Lorenzo Matteo Pierre Gualco, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 407 days.

This patent is subject to a terminal disclaimer.

(21) Appl. No.: 11/126,751

(22) Filed: May 11, 2005

(65) Prior Publication Data

US 2005/0256024 A1 Nov. 17, 2005

(30) Foreign Application Priority Data

May 11, 2004 (EP) ..... 04076391

(51) Int. Cl.
*C11D 17/04* (2006.01)
*C11D 3/20* (2006.01)

(52) U.S. Cl. ..... 510/296; 510/439; 510/400; 510/466

(58) Field of Classification Search ..... 510/296, 510/439, 400, 466
See application file for complete search history.

(56) References Cited

U.S. PATENT DOCUMENTS

| | | | | |
|---|---|---|---|---|
| 5,723,426 | A * | 3/1998 | Zhen et al. | 510/337 |
| 6,444,632 | B1 * | 9/2002 | Mondin | 510/296 |
| 6,486,109 | B1 * | 11/2002 | Mondin | 510/296 |
| 6,936,578 | B2 * | 8/2005 | Cordellina et al. | 510/296 |
| 6,958,313 | B2 * | 10/2005 | Caswell et al. | 510/296 |
| 7,033,987 | B2 * | 4/2006 | Depoot et al. | 510/437 |
| 7,056,877 | B2 * | 6/2006 | Caswell et al. | 510/439 |
| 7,179,777 | B2 * | 2/2007 | Blokzijl et al. | 510/287 |
| 2004/0142841 | A1 * | 7/2004 | de Buzzaccarini et al. | 510/296 |
| 2004/0152621 | A1 * | 8/2004 | Carvell et al. | 510/516 |

* cited by examiner

*Primary Examiner*—Lorna M Douyon
(74) *Attorney, Agent, or Firm*—Julie A. McConihay; Armina E. Matthews; Kim W. Zerby

(57) ABSTRACT

The present invention relates to a unit dose detergent product comprising a liquid fabric treatment composition and a water-soluble material, whereby the unit dose of the liquid composition is contained within the water-soluble material, wherein the liquid composition is a non-Newtonian, shear-thinning liquid having a low shear viscosity of at least 3,000 cps, when measured at a shear rate of 0.5 $s^{-1}$ and 20° C., and wherein the liquid composition comprises silicone oil, the silicone oil being emulsified in the liquid composition so that the mean particle diameter of the emulsified silicone oil droplets is from 5 to 50 micrometers.

3 Claims, No Drawings

UNIT DOSE DETERGENT PRODUCT COMPRISING SILICONE OIL

The present invention relates to a unit dose detergent product comprising a liquid composition and a water-soluble material, whereby the unit dose of the liquid composition is contained within the water-soluble material.

It is known to provide silicone emulsions in liquid detergent compositions for fabric softening benefits. U.S. Pat. No. 5,759,208, issued on Jun. 2, 1998, teaches that high particle size emulsions are preferred for softness. Silicone oil emulsions disclosed have an average particle size of from 5 to 500 micrometers.

However, high particle size silicone oil emulsions can, under certain circumstances, lead to "spotting" problems. This is when, after laundering, "spots" are visible on the laundered fabrics. These "spots" can be caused by large droplets of silicone oils.

The present invention deals with these problems by identifying the need to have a liquid composition with a low shear viscosity of at least 3000 cps, in combination with the silicone oil.

SUMMARY OF THE INVENTION

In order to address these problems the liquid composition of the present invention is a non-Newtonian, shear-thinning liquid having a low shear viscosity of at least 3,000 cps, when measured at a shear rate of 0.5 $s^{-1}$ and 20° C., and the liquid composition comprises silicone oil, the silicone oil being emulsified in the liquid composition so that the mean (by volume) particle diameter of the emulsified silicone oil droplets is from 5 to 50 micrometers, preferably 10 to 20 micrometers.

DETAILED DESCRIPTION OF THE INVENTION

Preferably, the silicone oil is selected from the group consisting of nonionic nitrogen-free silicone polymers having the formulae (I) to (III):

(I)

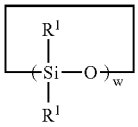

;

(II)

$$R^2-(R^1)_2SiO-[(R^1)_2SiO]_a-[(R^1)(R^2)SiO]_b-Si(R^1)_2-R^2;$$

(III)

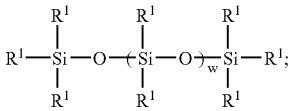

and mixtures thereof, wherein each $R^1$ is independently selected from the group consisting of linear, branched or cyclic substituted or unsubstituted alkyl groups having from 1 to 20 carbon atoms; linear, branched or cyclic substituted or unsubstituted alkenyl groups having from 2 to 20 carbon atoms; substituted or unsubstituted aryl groups having from 6 to 20 carbon atoms; substituted or unsubstituted alkylaryl, substituted or unsubstituted arylalkyl and substituted or unsubstituted arylalkenyl groups having from 7 to 20 carbon atoms and mixtures thereof; each $R^2$ is independently selected from the group consisting of linear, branched or cyclic substituted or unsubstituted alkyl groups having from 1 to 20 carbon atoms; linear, branched or cyclic substituted or unsubstituted alkenyl groups having from 2 to 20 carbon atoms; substituted or unsubstituted aryl groups having from 6 to 20 carbon atoms; substituted or unsubstituted alkylaryl groups, substituted or unsubstituted arylalkyl, substituted or unsubstituted arylalkenyl groups having from 7 to 20 carbon atoms and from a poly(ethyleneoxide/propyleneoxide) copolymer group having the general formula (IV):

$$-(CH_2)_nO(C_2H_4O)_c(C_3H_6O)_dR^3$$

with at least one $R^2$ being a poly(ethyleneoxy/propyleneoxy) copolymer group, and each $R^3$ is independently selected from the group consisting of hydrogen, an alkyl having 1 to 4 carbon atoms, an acetyl group, and mixtures thereof, wherein the index w has the value as such that the viscosity of the nitrogen-free silicone polymer of formulae (I) and (III) is between 0.001 $m^2/s$ (1,000 centistokes) and 0.05 $m^2/s$ (50,000 centistokes); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the nitrogen-free silicone polymer is selected from the group consisting of linear nonionic nitrogen-free silicone polymers having the formulae (II) to (III) as above, wherein $R^1$ is selected from the group consisting of methyl, phenyl, phenylalkyl, and mixtures thereof; wherein $R^2$ is selected from the group consisting of methyl, phenyl, phenylalkyl, and mixtures thereof; and from the group having the general formula (IV), defined as above, and mixtures thereof; wherein $R^3$ is defined as above and wherein the index w has the value as such that the viscosity of the nitrogen-free silicone polymer of formula (III) is between 0.01 $m^2/s$ (10,000 centistokes) and 0.05 $m^2/s$ (50,000 centistokes); a is from 1 to 30, b is from 1 to 30, n is from 3 to 5, total c is from 6 to 100, total d is from 0 to 3, and total c+d is from 7 to 100.

Most preferably, the nitrogen-free silicone polymer is selected from the group consisting of linear nonionic nitrogen-free silicone polymers having the formula (III) as above, wherein $R^1$ is methyl, i.e. the polymer is a polydimethylsiloxane (PDMS). In the preferred PDMS the index w has a value such that its viscosity is between 0.001 $m^2/s$ (1,000 centistokes) and 0.05 $m^2/s$ (50,000 centistokes) and more preferably between 0.005 $m^2/s$ (5,000 centistokes) and 0.025$m^2/s$ (25000 centistokes), and mixtures thereof.

Another highly preferred silicone polymer composition is obtained by mixing two different PDMS polymers, one with a viscosity of 0.1-1.0 $m^2/s$ (100,000-1,000,000 centistokes), and the other one with a viscosity of 5-100×$10^{-6}$ $m^2/s$ (5-100 centistokes), so that the blend of the two materials has an overall viscosity which is between 0.005 $m^2/s$ (5,000 centistokes) and 0.02 $m^2/s$ (20,000 centistokes). A most preferred composition is a 60:40 blend of PDMS having an overall viscosity of 0.02 $m^2/s$ (20,000 centistokes).

Silicones are well known in the art for their fabric softening performance. Usually, these silicones are added as emulsions in water. Preferably, the fabric softening silicones are added as an emulsion of the silicone in the solvent, the solvent is preferably non-aqueous solvent, more preferably an organic solvent, and even more preferably selected from the group consisting of $C_1$-$C_{20}$ linear, branched, cyclic, saturated and/or unsaturated alcohols with one or more free hydroxy groups; amines, alkanolamines, and mixtures thereof. Preferred solvents are monoalcohols, diols, monoamine derivatives, glycerols, glycols, and mixtures thereof, such as ethanol, propanol, propandiol, monoethanolamin, glycerol, sorbitol, alkylene glycols, polyalkylene glycols, and mixtures thereof. Most preferred solvents are selected from the group consisting of 1,2-propandiol, 1,3-propandiol, glycerol, ethylene glycol, diethyleneglycol, and mixtures thereof. In a preferred embodiment of the present invention, premixes comprising fabric softening silicones and solvents are utilized in order to overcome process problems in terms of proper dispersion or dissolution of all ingredients throughout the composition. In another, more preferred embodiment, the silicones are added as pure oils to the liquid detergent composition.

Non-limiting examples of nitrogen-free silicone polymers of formula (II) are the Silwet® compounds which are available from OSI Specialties Inc., a Division of Witco, Danbury, Conn. Non-limiting examples of nitrogen-free silicone polymers of formula (I) and (III) are the Silicone 200 Fluid®-series from Dow Corning or the Baysilone® M series from GE-Bayer.

(iii) Cationic silicone polymers can optionally be present in the fabric softening system of the present invention as additional fabric softening materials, in addition to a cationic guar gum or in addition to a cationic guar gum and an ammonium-based fabric softening agent as fabric softening agents.

Suitable cationic silicones polymers are disclosed in the Applicant's co-pending case WO 02/18 528.

Cationic silicones are well known in the art for their fabric softening performance. Usually, these cationic silicones are added as emulsions in water. As states above for the fabric softening clays, the use of aqueous emulsions of fabric softening cationic silicones is not preferred when the final composition is to be placed in water-soluble pouches. In order to overcome this technical problem, the present invention suggest adding the fabric softening cationic silicones suitable for use in the present invention either as a premix comprising the cationic silicone and a solvent, or adding the cationic silicones as pure compounds without any solvent. When the fabric softening cationic silicones are added as a premix, the premix is most likely a slurry or dispersion or suspension or emulsion of the silicone in the solvent. The solvent is preferably non-aqueous solvent, more preferably an organic solvent, and even more preferably selected from the group consisting of $C_1$-$C_{20}$ linear, branched, cyclic, saturated and/or unsaturated alcohols with one or more free hydroxy groups; amines, alkanolamines, and mixtures thereof. Preferred solvents are monoalcohols, diols, monoamine derivatives, glycerols, glycols, and mixtures thereof, such as ethanol, propanol, propandiol, monoethanolamin, glycerol, sorbitol, alkylene glycols, polyalkylene glycols, and mixtures thereof. Most preferred solvents are selected from the group consisting of 1,2-propandiol, 1,3-propandiol, glycerol, ethylene glycol, diethyleneglycol, and mixtures thereof. In a preferred embodiment of the present invention, premixes comprising fabric softening cationic silicones and solvents are utilized in order to overcome process problems in terms of proper dispersion or dissolution of all ingredients throughout the composition.

Particle size measurement —silicone emulsion particle sizes are measured using a Coulter Multisizer® from Coulter Electronics Ltd.

General method of making larger — sized silicone emulsions—The silicone emulsion is typically made by mixing silicone fluid with a solution of emulsifying surfactants at a specific viscosity ratio using an impeller mixer for a certain period of time.

See also "Colloidal Systems and Interfaces" by Sydney Ross and Ian D. Morrison, John Wiley & Sons, 1988, and "Emulsion Science" by Philip Sherman, Academic Press, 1968, for procedures for making emulsions.

Typically, commercially available silicone emulsions, such as Dow Corning Emulsion 8® and GE SM2061®, are less than 5 micrometers, many less than 1 micrometer.

In contrast, for the purposes of the present invention, the mean (by volume) particle diameter of the emulsified silicone oil droplets is from 5 to 50 micrometers, preferably from 10 to 20 micrometers.

Unit Dose

The unit dose can be of any form, shape and material which is suitable to hold the composition, e.g., without allowing the release of the composition from the pouch prior to contact of the pouch with water during laundering. The exact execution will depend on, for example, the type and amount of the composition in the pouch, the characteristics required from the pouch to hold, protect and deliver or release the compositions.

The unit dose is typically made from a water-soluble film. Preferred water-soluble films are polymeric materials, preferably polymers which are formed into a film. The material in the form of a film can for example be obtained by casting, blow-moulding, extrusion or blow extrusion of the polymer material, as known in the art.

The water-soluble films for use herein typically have a solubility of at least 50%, preferably at least 75% or even at least 95%, as measured by the method set out hereinafter using a glass-filter with a maximum pore size of 50 microns, namely:

Gravimetric method for determining water-solubility of the material of the compartment and/or pouch:

50 g±0.1 g of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 μm). The water is dried off from the collected filtrate by any conventional method, and the weight of the remaining polymer is determined (which is the dissolved or dispersed fraction). Then, the percentage solubility or dispersability can be calculated.

Preferably, the film is stretched such that the thickness variation in the pouch formed of the stretched water-soluble film is from 10 to 1000%, preferably 20% to 600%, or even 40% to 500% or even 60% to 400%. This can be measured by any method, for example by use of an appropriate micrometer. Preferably the pouch is made from a water-soluble film that is stretched, and wherein the film has a stretch degree of from 40% to 500%, preferably from 40% to 200%.

The film preferably has a thickness of from 1 μm to 200 μm, more preferably from 15 μm to 150 μm, even more preferably from 30 μm to 100 μm.

Preferably, the fabric treatment composition is a composition to be delivered to water and thus, the pouch and the compartment thereof are designed such that its contents are released at, or very shortly after, the time of placing the pouch in water. Thus, it is preferred that the pouch with is compartment is formed from a material which is water-soluble. In one preferred embodiment, the component is delivered to the water within 3 minute, preferably even within 2 minutes or even within 1 minute after contacting the pouched composition with water.

In general, the pouch can be made from any material suitable for use in conventional unit dose laundry products. However, it has been found that certain polymer and/or copolymers and/or derivatives thereof are preferred. Preferred polymer and/or copolymers and/or derivatives thereof are selected from polyvinyl alcohol (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum; and mixtures thereof. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and mixtures thereof, most preferably polyvinyl alcohols, polyvinyl alcohol copolymers, hydroxypropyl methyl cellulose (HPMC), and mixtures thereof. Preferably, the level of polymer in the film, for example a PVA polymer, is at least 60%.

The polymer can have any weight average molecular weight, preferably from 1000 to 1,000,000, or even from 10,000 to 300,000 or even from 15,000 to 200,000 or even from 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the pouch compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000 to 40,000, preferably around 20,000, and of PVA or copolymer thereof, with a weight average molecular weight of 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1% to 60% by weight polylactide and approximately from 40% to 99% by weight polyvinyl alcohol.

It may be preferred that the polymer present in the film is from 60% to 98% hydrolysed, preferably from 80% to 90%, to improve the dissolution of the film.

Most preferred films are films which comprise a PVA polymer with similar properties to the film which comprises a PVA polymer and is known under the trade reference M8630, as sold by Monosol LLC of Gary, Indiana, US. Another preferred film is known under the trade reference PT-75, sold by Aicello Chemical Europe GmbH, Carl-Zeiss-Strasse 43, 47445 Moers, Del.

The film herein may comprise other additive ingredients besides the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful when the composition herein is a detergent composition, that the film itself comprises a detergent additive to be delivered to the wash water, for example, organic polymeric soil release agents, dispersants, dye transfer inhibitors.

Fabric Treatment Composition

Unless stated otherwise all percentages herein are weight percent of the final composition excluding the pouch film forming material.

The pouch contains a liquid fabric treatment composition which is a non-Newtonian, shear-thinning liquid.

The liquid fabric treatment composition is generally non-aqueous. For the purpose of the present invention, the composition is non-aqueous if it contains less than 15% wt., preferably between 2% to 15% wt., more preferably between 5% and 12% wt. by weight of the fabric treatment composition, of water. This is on basis of total water by weight of the total fabric treatment composition.

The liquid composition can made by any method and are non-Newtonian shear-thinning liquids having a low shear viscosity of at least 3,000 cps when measured at a shear rate of 0.5 $S^{-1}$ and at 20° C.

The liquid composition preferably has a density of 0.8 kg/l to 1.3 kg/l, preferably around 1.0 to 1.1 kg/l.

Highly preferred in all above compositions is the presence of an additional solvent, which is preferably an organic solvent, more preferably selected from the group consisting of C1-C20 linear, branched, cyclic, saturated and/or unsaturated alcohols with one or more free hydroxy groups; amines, alkanolamines, and mixtures thereof. Even more preferred solvents are monoalcohols, diols, monoamine derivatives, glycerols, glycols, and mixtures thereof, such as ethanol, propanol, propandiol, monoethanolamin, glycerol, sorbitol, alkylene glycols, polyalkylene glycols, and mixtures thereof, and most preferred solvents are selected from 1,2-propandiol, 1,3-propandiol, glycerol, ethylene glycol, diethyleneglycol, and mixtures thereof.

The compositions used in the present invention comprise solvents at levels of from 0.1% to 90%, preferably of from 10% to 70%, more preferably of from 12% to 40% and most preferably of from 15% to 30% by weight of the fabric treatment composition.

Anionic Surfactants

Nonlimiting examples of anionic surfactants optionally useful herein include:

a) $C_{11}$-$C_{18}$ alkyl benzene sulfonates (LAS);

b) $C_{10}$-$C_{20}$ primary, branched-chain and random alkyl sulfates (AS);

c) $C_{10}$-$C_{18}$ secondary (2,3) alkyl sulfates having formulae (I) and (II):

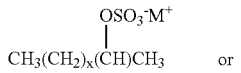

(I)

or

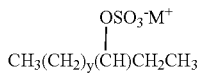

(II)

M in formulae (I) and (II) is hydrogen or a cation which provides charge neutrality. For the purposes of the present invention, all M units, whether associated with a surfactant or adjunct ingredient, can either be a hydrogen atom or a cation depending upon the form isolated by the artisan or the relative pH of the system wherein the compound is used. Non-limiting examples of preferred cations include sodium, potassium, ammonium, and mixtures thereof. Wherein x in formulae (I) and (II)

is an integer of at least about 7, preferably at least about 9; y in formulae (I) and (II) is an integer of at least 8, preferably at least about 9;

d) $C_{10}$-$C_{18}$ alkyl alkoxy sulfates ($AE_xS$) wherein preferably x is from 1-30;

e) $C_{10}$-$C_{18}$ alkyl alkoxy carboxylates preferably comprising 1-5 ethoxy units;

f) mid-chain branched alkyl sulfates as discussed in U.S. Pat. No. 6,020,303 and U.S. Pat. No. 6,060,443;

g) mid-chain branched alkyl alkoxy sulfates as discussed in U.S. Pat. No. 6,008,181 and U.S. Pat. No. 6,020,303;

h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548.;

i) methyl ester sulfonate (MRS); and j) alpha-olefin sulfonate (AOS)

Nonionic Surfactants

Non-limiting examples of optional nonionic surfactants include:

a) $C_{12}$-$C_{18}$ alkyl ethoxylates, such as, NEODOL® nonionic surfactants from Shell;

b) $C_6$-$C_{12}$ alkyl phenol alkoxylates wherein the alkoxylate units are a mixture of ethyleneoxy and propyleneoxy units;

c) $C_{12}$-$C_{18}$ alcohol and $C_6$-$C_{12}$ alkyl phenol condensates with ethylene oxide/propylene oxide block polymers such as Pluronic® from BASF;

d) $C_{14}$-$C_{22}$ mid-chain branched alcohols, BA, as discussed in U.S. Pat. No. 6,150,322;

e) $C_{14}$-$C_{22}$ mid-chain branched alkyl alkoxylates, $BAE_x$, wherein x 1-30, as discussed in U.S. Pat. No. 6,153,577, U.S. Pat. No. 6,020,303 and U.S. Pat. No. 6,093,856;

f) Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779;

g) Polyhydroxy fatty acid amides as discussed in U.S. Pat. No. 5,332,528, WO 92/06162, WO 93/19146, WO 93/19038, and WO 94/09099;

h) ether capped poly(oxyalkylated) alcohol surfactants as discussed in U.S. Pat. No. 6,482,994 and WO 01/42408; and Cationic Surfactants Non-limiting examples of optional cationic surfactants include: the quaternary ammonium surfactants, which can have up to 26 carbon atoms.

a) alkoxylate quaternary ammonium (AQA) surfactants as discussed in U.S. Pat. No. 6,136,769;

b) dimethyl hydroxyethyl quaternary ammonium as discussed in U.S. Pat. No. 6,004,922;

c) polyamine cationic surfactants as discussed in WO 98/35002, WO 98/35003, WO 98/35004, WO 98/35005, and WO 98/35006;

d) cationic ester surfactants as discussed in U.S. Pat. Nos. 4,228,042, 4,239,660 4,260,529 and U.S. Pat. No. 6,022,844; and e) amino surfactants as discussed in U.S. Pat. No. 6,221,825 and WO 00/47708, specifically amido propyldimethyl amine.

Generally, the surfactant is present at levels above 5%, preferably between 10% to 80% and more preferably from 20% to 60% by weight of the fabric treatment composition.

Builders

The cleaning compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

Builders include, but are not limited to, the alkali metal, ammonium and alkanolammonium salts of polyphosphates, alkali metal silicates, alkaline earth and alkali metal carbonates, aluminosilicate builders polycarboxylate compounds ether hydroxypolycarboxylates, copoly-mers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

In a preferred embodiment of the present invention, at least one builder is present. More preferably, at least one water-soluble builder is present, and even more preferably at least one fatty acid builder is present. The most preferred builders suitable for incorporation in the compositions of the present invention are citric acid and or C12-C18 alkyl fatty acid.

Structuring Agent

The compositions in accordance with the present invention preferably contain a structuring agent, typically present of from 0.01% to 10%, preferably from 0.05% to 5%, more preferably from 0.1% to 1% by weight of the fabric treatment composition. The structuring agent serves to stabilize the fabric care compositions herein and to prevent the fabric treatment compositions herein from coagulating and/or creaming.

Preferably the structuring agent is a crystalline, hydroxyl-containing structuring agent, more preferably still, a trihydroxystearin, hydrogenated oil or a variation thereof.

Without intending to be limited by theory, the crystalline, hydroxyl-containing stabilizing agent is a nonlimiting example of an agent which forms a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be adjusted such as to provide a non-Newtonian shear-thinning liquid composition having a low shear viscosity of at least 3000 cps, when measured at a shear rate of 0.5 $s^{-1}$ and 20° C. A process for the preparation of a thread-like structuring system is disclosed in WO 02/18528.

Crystalline, hydroxyl-containing stabilizing agents can be fatty acid, fatty ester or fatty soap water-insoluble wax-like substance.

The crystalline, hydroxyl-containing stabilizing agents in accordance with the present invention are preferably derivatives of castor oil, especially hydrogenated castor oil derivatives. For example, castor wax.

The crystalline, hydroxyl-containing agent typically is selected from the group consisting of:

i)

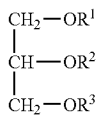

wherein $R^1$ is —C(O)$R^4$, $R^2$ is $R^1$ or H, $R^3$ is $R^1$ or H, and $R^4$ is independently $C_{10}$-$C_{22}$ alkyl or alkenyl comprising at least one hydroxyl group;

ii)

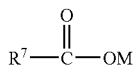

wherein:

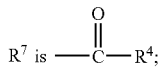

$R^4$ is as defined above in i);

M is $Na^+$, $K^+$, $Mg^{++}$ or $Al^{3+}$, or H; and iii) mixtures thereof.

Alternatively, the crystalline, hydroxyl-containing stabilizing agent may have the formula:

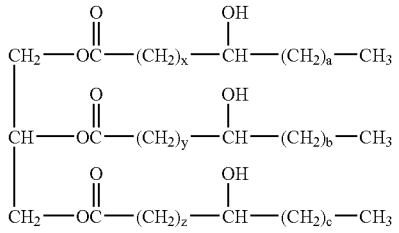

wherein:

(x+a) is from between 11 and 17; (y+b) is from between 11 and 17; and (z+c) is from between 11 and 17. Preferably, wherein x=y=z=10 and/or wherein a=b=c=5.

Commercially available crystalline, hydroxyl-containing stabilizing agents include THIXCIN® from Rheox, Inc.

Further Softening Actives

The compositions of the present invention may optionally comprise additional fabric softening actives. These additional softeners can be present in an amount of from 0.1% to 20%, preferably between 1% to 15%, and more preferably between 1.5% to 10% by weight of the fabric treatment composition.

(a) Fabric softening clays can optionally be present in the fabric softening system of the present invention as additional fabric softening materials. Preferred clays are of the smectite type.

Smectite type clays are widely used as fabric softening ingredients in detergent compositions. Most of these clays have a cation exchange capacity of at least 50 meq/100 g.

Smectite clays can be described as three-layer expandable materials, consisting of alumino-silicates or magnesium silicates.

The smectite clays commonly used for this purpose herein are all commercially available. Such clays include, for example, montmorillonite, volchonskoite, nontronite, hectorite, paonite, sauconite, and vermiculite. The clays herein are available under commercial names such as "fooler clay" (clay found in a relatively thin vein above the main bentonite or monmorillonite veins in the Black Hills) and various tradenames such as Thixogel #1 (also, "Thixo-Jell") and Gelwhite GP from Georgia Kaolin Co. Elizabeth, N.J.; Volclay BC and Volclay #325, from American Colloid Co., Skokie, Ill.; Black Hills Bentonite BH 450, from International Minerals and Chemicals; and Veegum Pro and Veegum F, from R. T. Vanderbuilt. It is to be recognized that such smectite-type minerals obtained under the foregoing commercial and tradenames can comprise mixtures of the various discrete mineral entitites. Such mixtures of the smecite minerals are suitable for use herein.

Preferred for use herein are the montmorrillonite clays having an ion exchange capacity of 50 to 100 meq/10 g which corresponds to ca. 0.2 to 0.6 layer charge.

Quite suitable are hectorites of natural origin, in the form of particles having the general formula:

$$\underset{M^{n+}}{[(Mg_{3-x}Li_x)Si_{4-y}ME^{III}_yO_{10}(OH_{2-z}F_z)]^{-(x+y)}}(x+y)/n$$

wherein $Me^{III}$ is Al, Fe, or B; or y=o; $M^{n+}$ is a monovalent (n=1) or divalent (n=2) metal ion, for example selected from the group consisting of Na, K, Mg, Ca, Sr, and mixtures thereof. In the above formula, the value of (x+y) is the layer charge of the hectorite clay. Such hectorite clays are preferably selected on the basis of their layer charge properties, i.e. at least 50% is in the range of from 0.23 to 0.31. More suitable are hectorite clays of natural origin having a layer charge distribution such that at least 65% is in the range of from 0.23 to 0.31.

The hectorite clays suitable in the present composition should preferably be sodium clays, for better softening activity.

Sodium clays are either naturally occurring, or are naturally-occuring calcium-clays which have been treated so as to convert them to sodium-clays. If calcium-clays are used in the present compositions, a salt of sodium can be added to the compositions in order to convert the calcium clay to a sodium clay. Preferably, such a salt is sodium carbonate, typically added at levels of up to 5% of the total amount of clay.

Examples of hectorite clays suitable for the present compositions include Bentone EW and Macaliod, from NL Chemicals, NJ, US, and hectorites from Industrial Mineral Ventures.

Another preferred clay is an organophilic clay, preferably a smectite clay, whereby at least 30% or even at least 40% or preferably at least 50% or even at least 60% of the exchangeable cations is replaced by a, preferably long-chain, organic cations. Such clays are also referred to as hydrophobic clays.

Highly preferred are organophilic clays as available from Rheox/Elementis, such as Bentone SD-1 and Bentone SD-3, which are registered trademarks of Rheox/Elementis.

Clays are well known in the art for their fabric softening performance. In general, clays are usually processed as aqueous suspensions. However, the use of aqueous suspensions of fabric softening clays is not preferred when the final composition is surrounded by a water-soluble pouch, because the water content present would lead at least partly to an early and therefore unwanted dissolution of the pouch material, i.e. before the consumer places the pouch in the washing machine, and therefore resulting in loss of treatment composition available for the laundry cycle and/or causing a mess in the consumers home. In order to overcome this technical problem, the present invention suggests adding clays as pure compounds or as premixes. These premixes comprise the clay and a solvent, preferably a non-aqueous solvent. Due to the dissolution profile of most clays, the premix is most likely a slurry or dispersion or suspension or emulsion of the clay in the respective solvent. The solvent is preferably an organic solvent, more preferably the organic solvent is selected from the group consisting of $C_1$-$C_{20}$ linear, branched, cyclic, saturated or unsaturated alcohols with one or more free hydroxy groups; amines, alkanolamines; and mixtures thereof. Even more preferred solvents include monoalcohols, diols, monoamine derivatives, glycerols, glycols, and mixtures thereof, such as ethanol, propanol, propandiol, monoethanolamin, glycerol, sorbitol, alkylene glycols, polyalkylene glycols, and mixtures thereof, and most preferred solvents are selected from the group consisting of 1,2-propandiol, 1,3-propandiol, glycerol, ethylene glycol, diethyleneglycol, and mixtures thereof. In a preferred embodiment of the present invention, premixes comprising fabric softening clays and solvents are utilized in order to overcome process problems in terms of proper dispersion or dissolution of all ingredients throughout the composition.

The fabric softening system can further comprise at least one fabric softening active selected from the group consisting of (i) cationic ammonium-based fabric softening compounds comprising at least one carbonyl functionality; wherein the molar ratio of anionic surfactant to ammonium-based fabric softener is at least 3:1; (ii) cationic guar gums with a charge density between 0.2 meq/gm to 5.0 meq/gm; and (iii) mixtures thereof.

(b) Cationic Ammonium-based fabric softening compound comprising at least one carbonyl functionality—

Quaternary Ammonium Fabric Softening Active Compounds

The preferred fabric softening actives of the present invention are the Diester and/or Diamide Quaternary Ammonium (DEQA) compounds, the diesters and diamides having the formula:

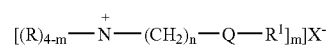

wherein each R unit is independently hydrogen, $C_1$-$C_6$ alkyl, $C_1$-$C_6$ hydroxyalkyl, and mixtures thereof, preferably methyl or hydroxy alkyl; each $R^1$ unit is independently linear or branched $C_{11}$-$C_{22}$ alkyl, linear or branched $C_{11}$-$C_{22}$ alkenyl, and mixtures thereof, $R^2$ is hydrogen, $C_1$-$C_4$ alkyl, $C_1$-$C_4$ hydroxyalkyl, and mixtures thereof; X is an anion which is compatible with fabric softener actives and adjunct ingredients; the index m is from 1 to 4, preferably 2; the index n is from 1 to 4, preferably 2, and Q has the formula:

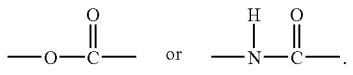

The counterion, $X^{(-)}$ above, can be any softener-compatible anion, preferably the anion of a strong acid, for example, chloride, bromide, methylsulfate, ethylsulfate, sulfate, nitrate and the like, more preferably chloride or methyl sulfate. The anion can also, but less preferably, carry a double charge in which case $X^{(-)}$ represents half a group.

Tallow and canola oil are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty acyl units. Likewise, the use of the term canolyl refers to a mixture of fatty acyl units derived from canola oil.

TABLE I

| Fabric Softener Actives |
|---|
| N,N-di(tallowyl-oxy-ethyl)-N,N-dimethyl ammonium chloride; |
| N,N-di(canolyl-oxy-ethyl)-N,N-dimethyl ammonium chloride; |
| N,N-di(tallowyl-oxy-ethyl)-N-methyl, N-(2-hydroxyethyl) ammonium chloride; |
| N,N-di(canolyl-oxy-ethyl)-N-methyl, N-(2-hydroxyethyl) ammonium chloride; |
| N,N-di(2-tallowyloxy-2-oxo-ethyl)-N,N-dimethyl ammonium chloride; |
| N,N-di(2-canolyloxy-2-oxo-ethyl)-N,N-dimethyl ammonium chloride |
| N,N-di(2-tallowyloxyethylcarbonyloxyethyl)-N,N-dimethyl ammonium chloride; |
| N,N-di(2-canolyloxyethylcarbonyloxyethyl)-N,N-dimethyl ammonium chloride; |
| N-(2-tallowoyloxy-2-ethyl)-N-(2-tallowyloxy-2-oxo-ethyl)-N,N-dimethyl ammonium chloride; |
| N-(2-canolyloxy-2-ethyl)-N-(2-canolyloxy-2-oxo-ethyl)-N,N-dimethyl ammonium chloride; |
| N,N,N-tri(tallowyl-oxy-ethyl)-N-methyl ammonium chloride; |
| N,N,N-tricanolyl-oxy-ethyl)-N-methyl ammonium chloride; |
| N-(2-tallowyloxy-2-oxoethyl)-N-(tallowyl)-N,N-dimethyl ammonium chloride; |
| N-(2-canolyloxy-2-oxoethyl)-N-(canolyl)-N,N-dimethyl ammonium chloride; |
| 1,2-ditallowyloxy-3-N,N,N-trimethylammoniopropane chloride; and |
| 1,2-dicanolyloxy-3-N,N,N-trimethylammoniopropane chloride; |
| mixtures of the above actives. |

Other examples of quaternary ammonium softening compounds are methylbis(tallowamidoethyl)(2-hydroxyethyl) ammonium methylsulfate and methylbis(hydrogenatedtallowamidoethyl)(2-hydroxyethyl) ammonium methylsulfate which are available from Witco Chemical Company under the trade names Varisoft® 222 and Varisoft® 110, respectively. Particularly preferred are N,N-di(canolyl-oxy-ethyl)-N,N-dimethyl ammonium chloride and N,N-di(canolyl-oxy-ethyl)-N-methyl, N-(2-hydroxyethyl) ammonium methyl sulfate.

(c) Cationic Guar Gums—Cationic guar gums can be present in the fabric softening system of the present invention. Guar gums are branched polysaccharides. They have a mannan backbone, a linear chain of 1,4-linked β-D-mannopyranosyl units, every other unit of which (on average) is substituted with a 1,6-linked α-D-galactopyranosyl unit. Like most polysaccharides, guar gum contains three free hydroxyl groups per sugar unit, which can be reacted with many chemicals. A commonly used procedure to make cationic guar gum includes: 1) hydroxypropyl guar is obtained by condensation of guar gum with propylene oxide; 2) cationic guar gum is formed by the reaction of hydroxypropyl guar with appropriate cationic agents. Commercially available cationic guar gums include N-Hance guar derivatives such as N-Hance 3196 and N-Hance 3000 from Hercules Incorporated of Wilmington, Del., Jaguar Excell and Jaguar C-13 from Rhodia of Aubervilliers, France. An ideal structure of a cationic guar gum is shown in the Structural Formula below.

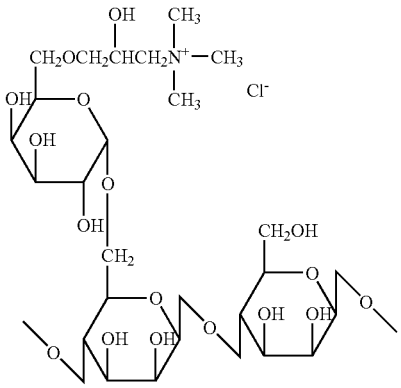

The molecular weight of cafionic guar gum needs to be at least 10,000 and preferably at least 50,000. The degree of cationic substitution for use with the present invention should be in the range of 0.01 to 1.00 and preferably from 0.02 to 0.50. The charge density of the guar gums suitable for use in the compositions of the present invention is between 0.2 meq/gm to 5.0 meq/gm, preferably between 0.25 meq/mg to 3 meq/gm, and more preferably between 0.3 meq/gm to 2 meq/gm at the pH of intended use of the composition, which will generally range from pH 3 to pH 9, preferably between pH 4and pH 8.

Other Ingredients

Other ingredients suitable for use in liquid compositions of the present invention include chelating agents, bleaching agents, soil suspension polymers, enzymes, dye transfer inhibitors, hydrotropes. The liquid composition comprises preferably a colorant or dye and/or pearlescence agent. Highly preferred are also perfume, brightener, buffering agents (to maintain the pH preferably from 5.5 to 9, more preferably 6 to 8), and suds suppressors, anti-wrinkling agent.

EXAMPLES

A liquid composition was made as set out in Table 1. The liquid composition, prior to addition of the Polydimethylsiloxane and the Hydrogenated Castor Oil, is an isotropic clear liquid. The Polydimethylsiloxane is then added to the clear liquid under controlled mixing parameters to obtain the desired particle size. The composition is then divided into separate portions prior to addition of hydrogenated castor oil, and each portion was subjected to a different amount of shear mixing following the castor oil addition. This results in identically formulated liquid compositions which have different low shear viscosities as indicated in Table 2.

Unit dose detergent products are made by sealing 50 ml of the different compositions within a commercially available polyvinyl alcohol water-soluble film, Monosol®8630, to make a pillow-shaped pouch having approximate dimensions 50 mm×40 mm×10 mm.

A horizontal vacuum-filling machine is used to fill the liquid unit dose, as disclosed in WO02/060758. The top PVA film of the pouch is applied and vacuum stretched to fit the mold. The liquid composition is poured in (top part of the pouch). The pouch is then sealed with a second PVA sheet (bottom part of the pouch). The filled pouch is removed from the vacuum-filling machine and turned upright. Any extra PVA film is cut from the flange around the seal.

TABLE 1

| | % by weight |
|---|---|
| Alkylbenzene suffonic acid | 24 |
| C12-18' alkyl fatty acid (DTPKA) | 17.5 |
| C13-15 alcohol 7-ethoxylate | 19.5 |
| Monoethanolamine | 9.0 |
| Propane diol | 16.5 |
| Water | 6.5 |
| Ethoxylated polyethyleneimine | 3.2 |
| Polydimethylsiloxane | 2.3 |
| Hydrogenated castor oil | 0.2 |
| Enzyme, perfume, minors | to 100 |

TABLE 2

| Ex. | Low shear viscosity (cps) | Viscosity of PDMS* ($m^2/s$) | Particle size (micrometers) | Spotting** |
|---|---|---|---|---|
| 1 | 6,240 | 0.018 | 16 | 1 |
| 2 | 4,872 | 0.018 | 12 | 8 |
| 3 | 7,200 | 0.0123 | 19 | 6 |
| A | 1,460 | 0.018 | 28 | 167 |
| B | 2,450 | 0.018 | 21 | 60 |

**Number of visible spots observed after 5-cycles washing on "Eterna Excellent ®" shirts washed under standard European conditions, each cycle uses one unit dose.

*Viscosity of silicone oil "Baysilone M12,500 ®" in Example 3; or viscosity of blend of 2 silicone oils "Baysilone M100,000 ®" and "Baysilone M100 ®", at ratio of 60:40, in Examples 1, 2, A and B.

In Examples 1, 2 and 3, according to the invention, the low shear viscosity was 6,240, 4,872 and 7,200 cps respectively, when measured at a shear rate of 0.5 $s^{-}$and 20° C. In each case the "spotting" performance was excellent, i.e. less than 10 visible spots observed after 5-cycles washing on "Eterna Excellent®" shirts washed under standard European conditions (temperature 40° C., medium hardness 2.5 mmol/L Ca2+, short cycle (total cycle=1 hour)). "Etema Excellent®" shirts are 100% cotton with a silicone finish layer applied for Easy Care (ease of ironing, less wrinkles).

In comparative Examples A and B the low shear viscosity of the compositions was 1,460 and 2,460 cps respectively, when measured at a shear rate of 0.5 $s^{-1}$ and 20° C. Spotting values were significantly higher than those observed in the examples according to the invention.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A unit dose detergent product comprising a liquid fabric treatment composition and a water-soluble material, wherein the unit dose of the liquid composition is contained within the water-soluble material, wherein the liquid composition is a non-Newtonian, shear-thinning liquid having a low shear viscosity of at least about 3,000 cps, when measured at a shear rate of 0.5 $s^{-1}$ and 20° C., and wherein the liquid composition comprises from about 1% to about 5% by weight of polydimethyl siloxane, the polydimethyl siloxane being emulsified in the liquid composition so that the mean particle diameter of emulsified polydimethyl siloxane droplets is from about 5 to 20 micrometers.

2. A unit dose detergent product according to claim 1, wherein the silicone oil has a kinematic viscosity of from about 0.001 to about 0.05 $m^2/s$ when measured at a shear rate of 20 $s^{-1}$ and 20° C.

3. A unit dose detergent product according to claim 2, wherein the silicone oil has a kinematic viscosity of from about 0.005 to about 0.025 $m^2/s$ when measured at a shear rate of 20 $s^{-1}$ and 20° C.

* * * * *